US006874519B2

(12) United States Patent
Chiang

(10) Patent No.: US 6,874,519 B2
(45) Date of Patent: Apr. 5, 2005

(54) COLLAPSIBLE TENT SKELETON FRAME HAVING RIBS WITH ROUNDED ENDS

(75) Inventor: Yu Chiang, Taipei Hsien (TW)

(73) Assignee: Campack Tent Industrial Co., Ltd., Taipei (TW)

( * ) Notice: Subject to any disclaimer, the term of this patent is extended or adjusted under 35 U.S.C. 154(b) by 49 days.

(21) Appl. No.: 10/460,927

(22) Filed: Jun. 12, 2003

(65) Prior Publication Data

US 2004/0250847 A1 Dec. 16, 2004

(51) Int. Cl.[7] ..... E04H 15/50; E04H 15/52

(52) U.S. Cl. ..... 135/131; 135/135; 135/145; 135/146; 135/159; 135/147; 403/170; 403/218

(58) Field of Search ..... 135/130, 131, 135/135, 145, 146, 147, 151, 159; 403/170, 403/218

(56) References Cited

U.S. PATENT DOCUMENTS

| | | | | | |
|---|---|---|---|---|---|
| 4,637,748 | A * | 1/1987 | Beavers | 403/170 |
| 4,974,986 | A * | 12/1990 | Cook | 403/218 |
| 5,069,572 | A * | 12/1991 | Niksic | 403/170 |
| 5,794,640 | A * | 8/1998 | Jang | 135/131 |
| 5,797,695 | A * | 8/1998 | Prusmack | 403/170 |
| 6,152,157 | A * | 11/2000 | Jang | 135/131 |
| 6,296,415 | B1 * | 10/2001 | Johnson et al. | 403/170 |
| 6,508,262 | B1 * | 1/2003 | Takayama | 135/145 |

* cited by examiner

*Primary Examiner*—Robert Canfield
(74) *Attorney, Agent, or Firm*—Darby & Darby

(57) ABSTRACT

A collapsible tent skeleton frame includes a plurality of poles, a plurality of joints mounted respectively on the poles, a plurality of side ribs pivoted respectively to the joints, a top joint, and a plurality of upper ribs pivoted respectively to adjacent pairs of the side ribs and to the top joint. Each of the joints has two arms, each of which is formed with a recess that has a round inner end section and an extension. Each of the side ribs has a rounded end that is received in and that conforms to the inner end section of the recess in a respective one of the arms of a respective one of the joints.

3 Claims, 6 Drawing Sheets

COLLAPSIBLE TENT SKELETON FRAME HAVING RIBS WITH ROUNDED ENDS

BACKGROUND OF THE INVENTION

1. Field of the Invention

This invention relates to a collapsible tent skeleton frame, more particularly to a foldable skeleton frame having ribs with rounded ends.

2. Description of the Related Art

FIGS. 1 and 2 illustrate a conventional collapsible tent skeleton frame that includes a plurality of poles 112, a plurality of joint units 13, each of which is secured to a respective one of the poles 112, a plurality of side ribs 111, each of which is pivoted to a respective one of the joint units 13 through a pivot pin 14, and a plurality of upper ribs 113, each of which is pivoted to a top joint 15 and a respective one of the joint units 13.

The conventional skeleton frame is disadvantageous in that the pivotal connection between each of the side ribs 111 and the respective pivot joint 13 tends to be loosened after a period of use and that expanding and collapsing of the skeleton frame cannot be conducted in a smooth manner.

SUMMARY OF THE INVENTION

Therefore, the object of the present invention is to provide a collapsible tent skeleton frame that is capable of overcoming the aforesaid drawbacks of the prior art.

According to the present invention, there is provided a collapsible tent skeleton frame that comprises: a plurality of parallel poles extending in a vertical direction, each of the poles having a top end; a plurality of joint units, each of which is mounted securely on the top end of a respective one of the poles, and each of which includes an upper joint and a lower joint that is disposed below and that is spaced apart from the upper joint, each of the upper and lower joints having a sleeve that is sleeved on the respective one of the poles, and two pivot arms that extend outwardly and laterally from the sleeve and that are angled away from each other, each of the pivot arms having opposite top and bottom faces and a free end, and being formed with a first recess that extends inwardly from the free end in a transverse direction relative to the respective one of the poles, the first recess having a round inner end section that is remote from the free end, and an extension that is reduced and that extends from the inner end section in the transverse direction to the free end and that extends through the top and bottom faces in the vertical direction, the upper joint further having an upper cover that is secured to and that covers the top faces of the pivot arms of the upper joint, the lower joint further having a lower cover that is secured to and that covers the bottom faces of the pivot arms of the lower joint; a plurality of first side ribs, each of which has opposite first and second ends and a non-circular section that extends from the first end, and each of which extends inclinedly and downwardly from a respective one of the pivot arms of the upper joint on a respective one of the poles toward an adjacent one of the poles, the first end being rounded and being rotatably received in and conforming to the inner end section of the first recess in the respective one of the pivot arms of the upper joint on the respective one of the poles, the non-circular section being received in and conforming to the extension of the first recess in the respective one of the pivot arms of the upper joint on the respective one of the poles so as to limit rotation of the first side rib, each of the first side ribs being rotatable upwardly and downwardly about a first axis that is transverse to the respective one of the poles and to the respective one of the pivot arms of the upper joint on the respective one of the poles, each of the first side ribs being limited by the upper cover of the upper joint on the respective one of the poles from further upward rotation about the first axis, the second ends of an adjacent pair of the first side ribs being disposed between an adjacent pair of the poles and being pivoted to each other; a plurality of second side ribs, each of which has opposite first and second ends and a non-circular section that extends from the first end thereof, and each of which extends inclinedly and upwardly from a respective one of the pivot arms of the lower joint on a respective one of the poles toward an adjacent one of the poles, the first end of each of the second side ribs being rounded and being rotatably received in and conforming to the inner end section of the first recess in the respective one of the pivot arms of the lower joint on the respective one of the poles, the non-circular section of each of the second side ribs being received in and conforming to the extension of the first recess in the respective one of the pivot arms of the lower joint on the respective one of the poles so as to limit rotation of the second side rib, each of the second side ribs being rotatable upwardly and downwardly about a second axis that is transverse to the respective one of the poles and to the respective one of the pivot arms of the lower joint on the respective one of the poles, each of the second side ribs being limited by the lower cover of the lower joint on the respective one of the poles from further downward rotation about the second axis, the second ends of an adjacent pair of the second side ribs being disposed between an adjacent pair of the poles above the second ends of an adjacent pair of the first side ribs, and being pivoted to each other, each of the second side ribs intersecting and being pivoted to an adjacent one of the first side ribs; a top joint disposed above the top ends of the poles at a center position relative to the poles; and a plurality of upper ribs, each of which extends inclinedly and downwardly from the top joint, and each of which has a first end that is pivoted to the top joint, and a second end that is pivoted to the second end of one of an adjacent pair of the second side ribs.

BRIEF DESCRIPTION OF THE DRAWINGS

In drawings which illustrate an embodiment of the invention.

DETAILED DESCRIPTION OF THE PREFERRED EMBODIMENT

Figure 1:
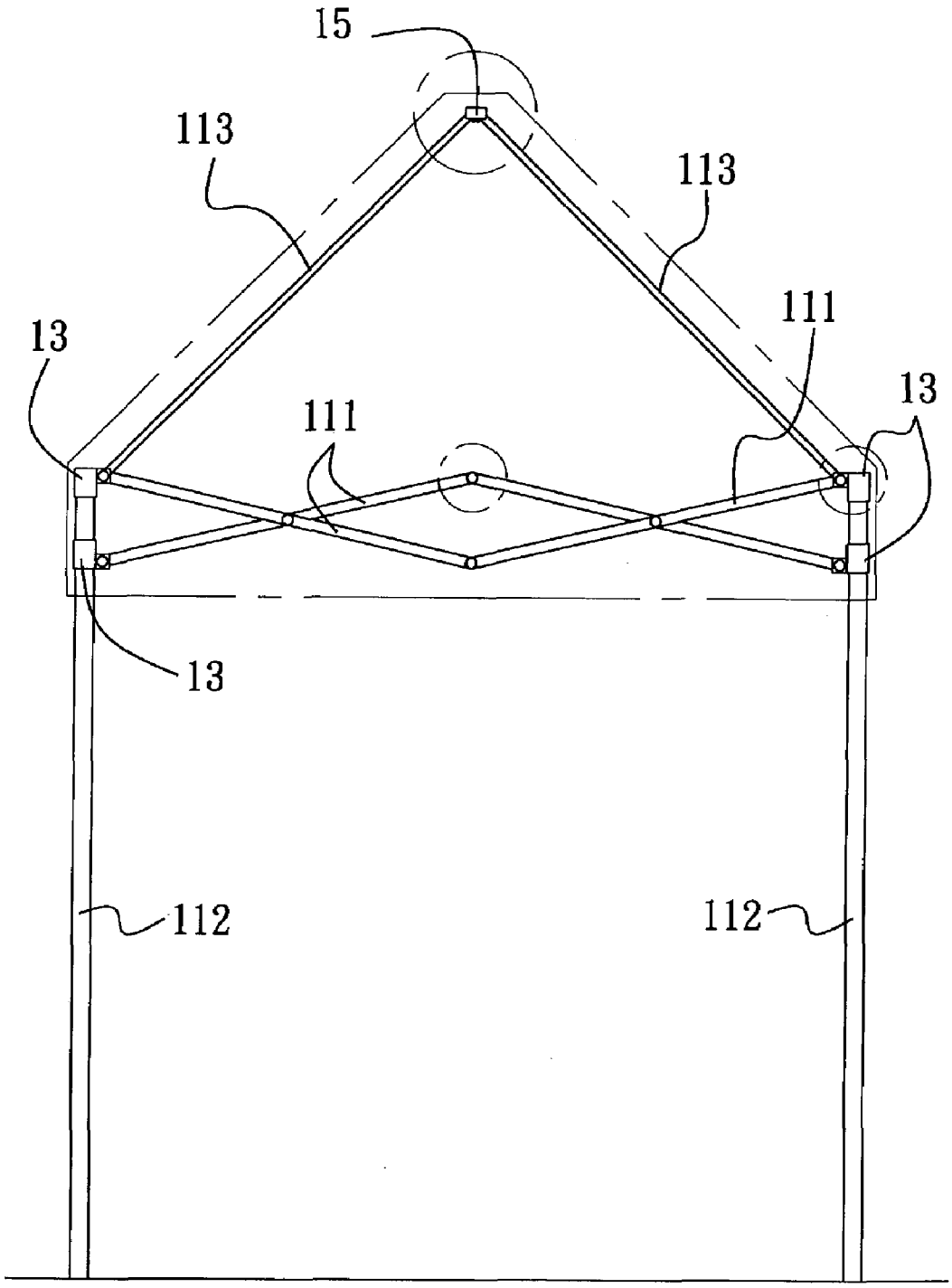
F I G. 1 PRIOR ART
FIG. 1 is a front view of a conventional collapsible tent skeleton frame.
Figure 2:
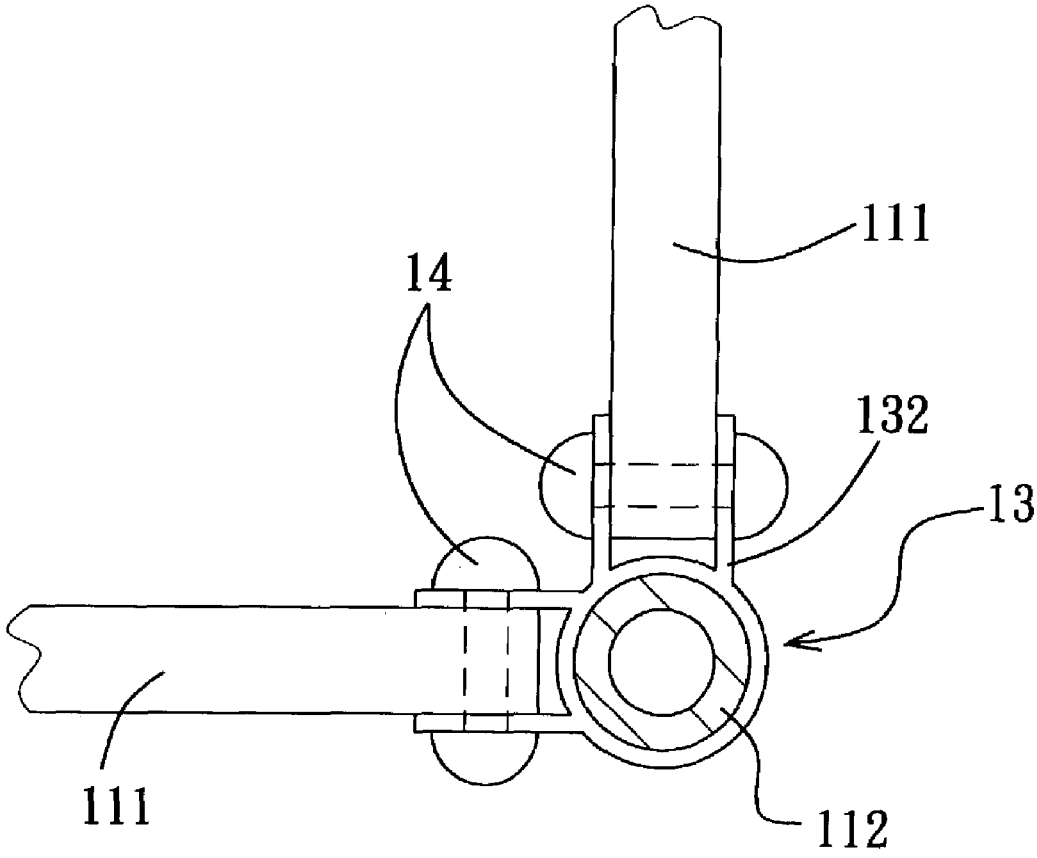
F I G. 2 PRIOR ART
FIG. 2 is a fragmentary top view of the skeleton frame of FIG. 1, illustrating pivotal connection between side ribs and a joint through pivot pins.
Figure 3:
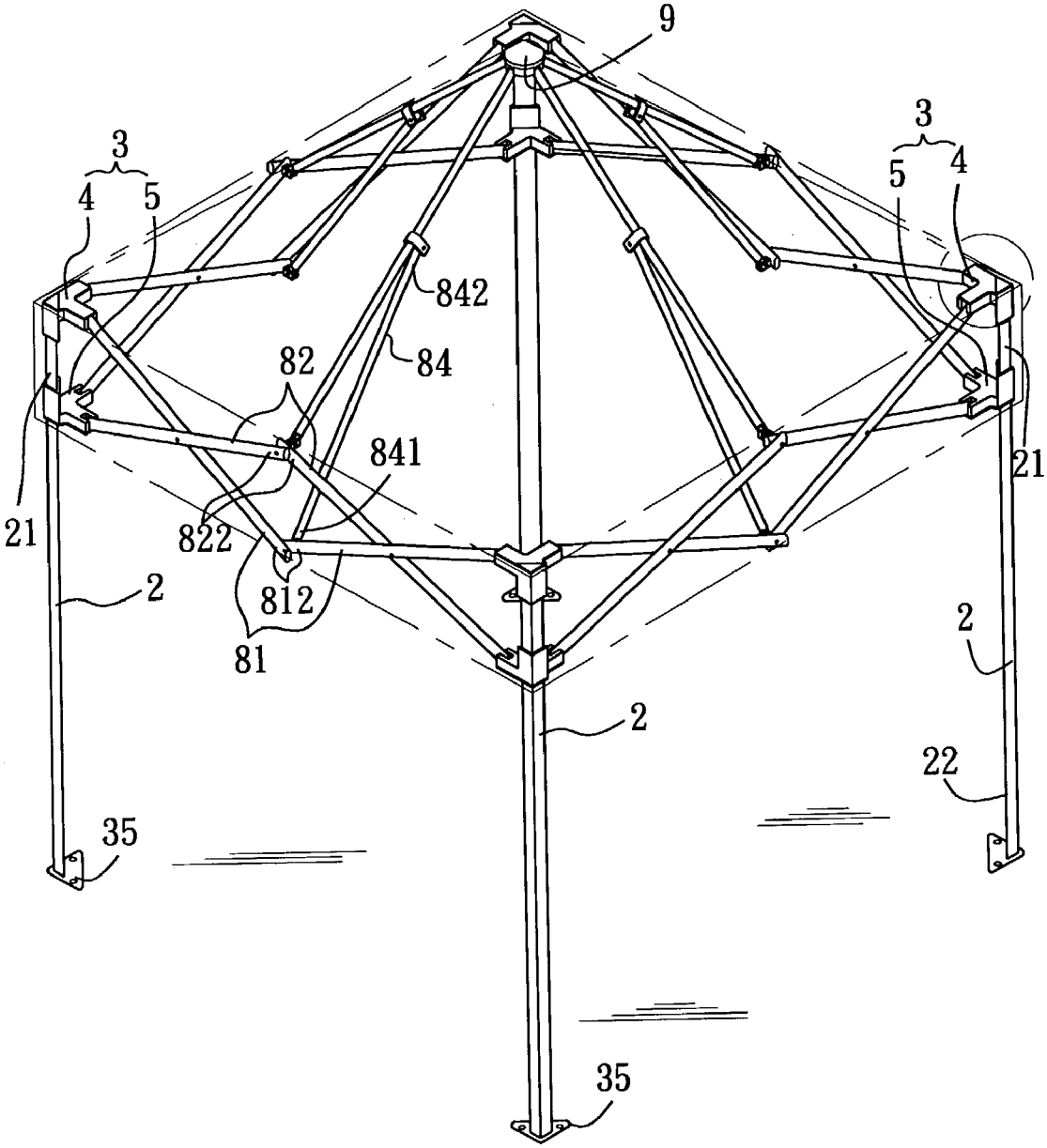
FIG. 3 is a perspective view of a collapsible tent skeleton frame embodying this invention.
Figure 4:
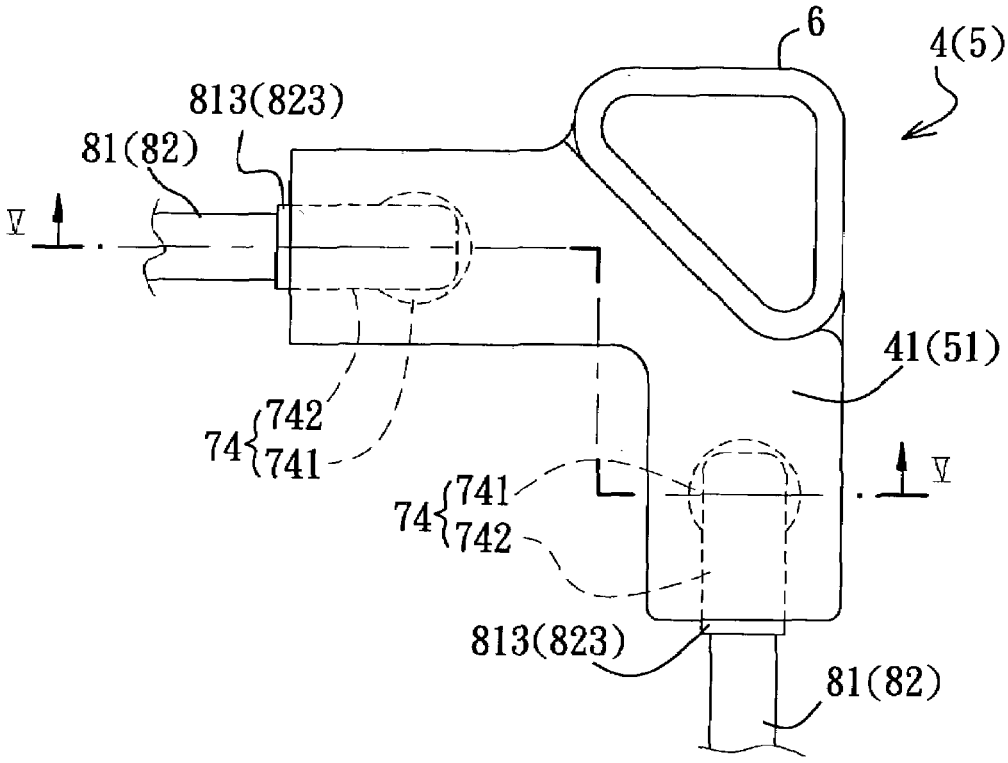
FIG. 4 is a fragmentary top view of the tent skeleton frame of FIG. 3, illustrating pivotal connection between a joint and adjacent side ribs.
Figure 5:
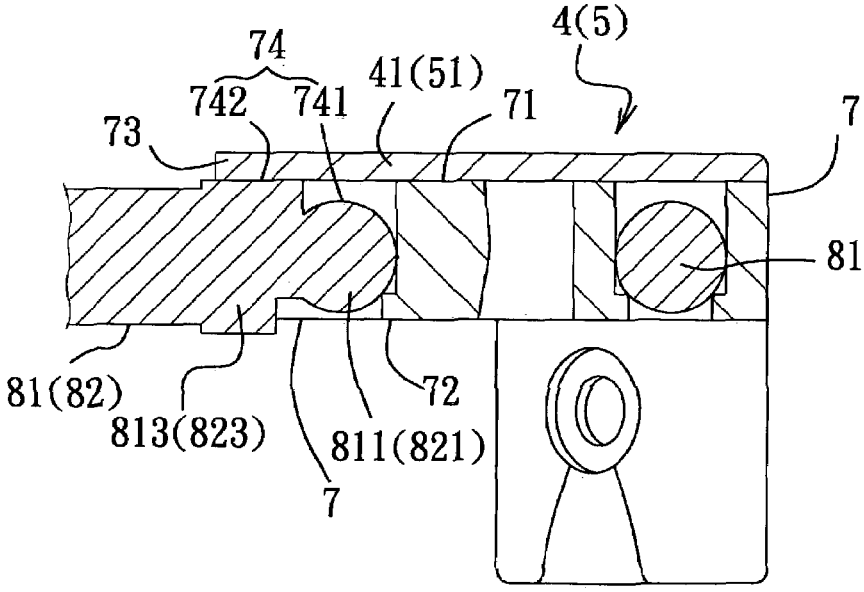
FIG. 5 is a fragmentary sectional view taken from lines V—V shown in FIG. 4.
Figure 6:
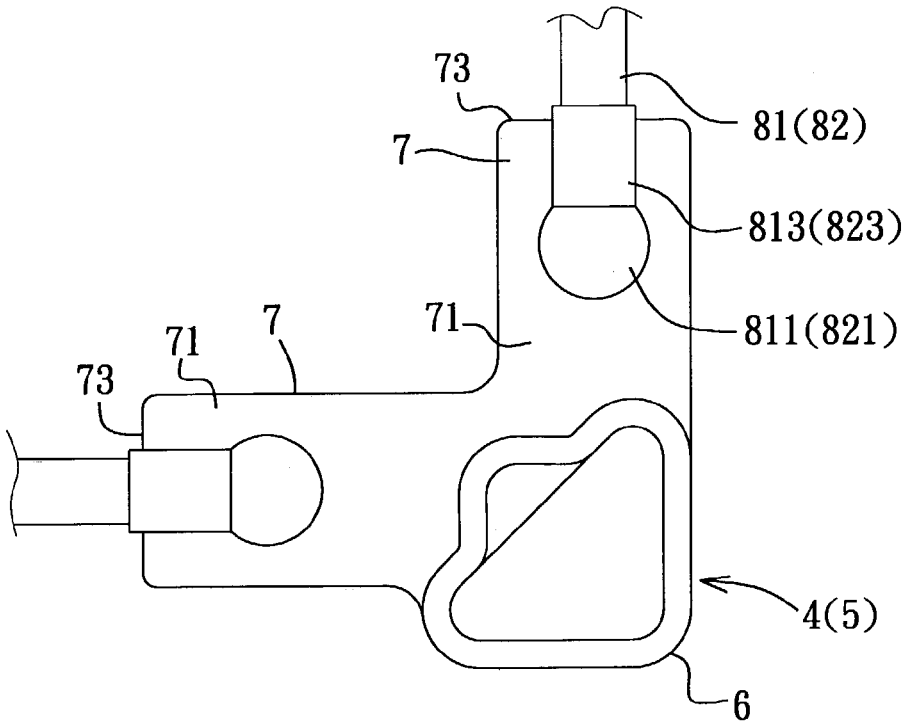
FIG. 6 is a view similar to FIG. 4, with a cover removed to expose the pivotal connection between the joint and the adjacent side ribs.
Figure 7:
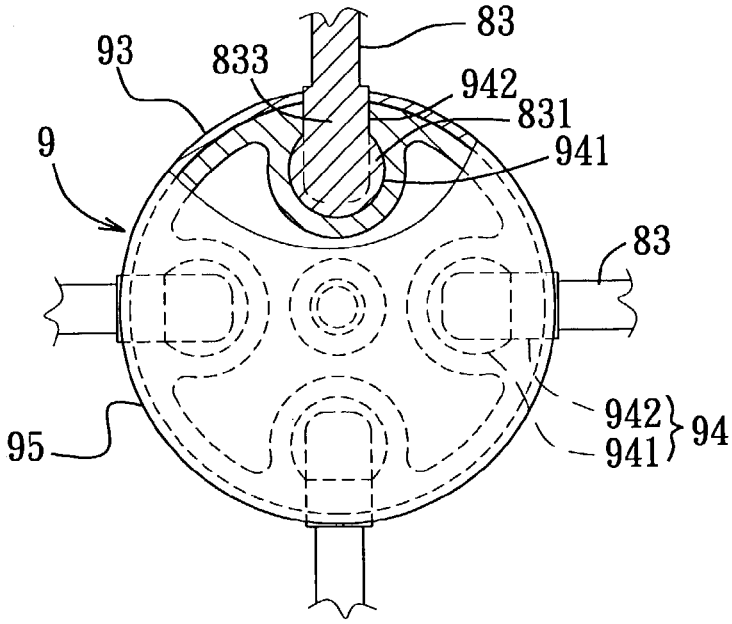
FIG. 7 is a cutaway, fragmentary, sectional top view of the tent skeleton frame of FIG. 3, illustrating pivotal connection between a top joint and upper ribs.
Figure 8:
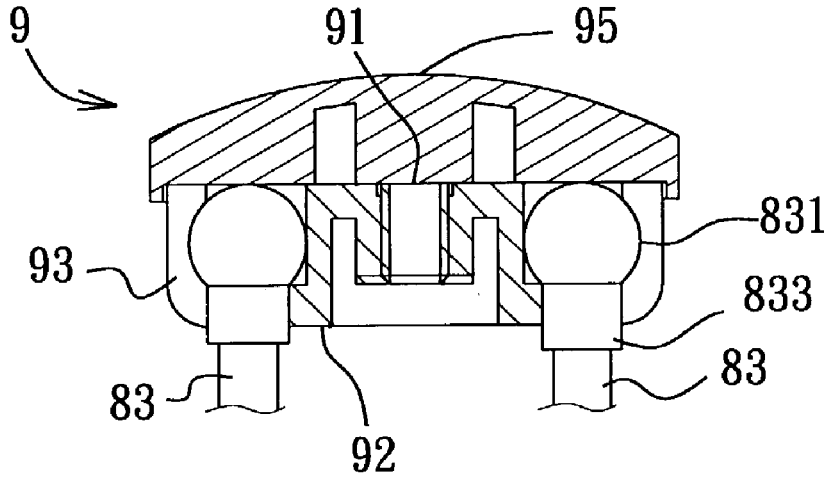
FIG. 8 is a fragmentary sectional view to illustrate the pivotal connection between the top joint and the upper ribs.
Figure 9:
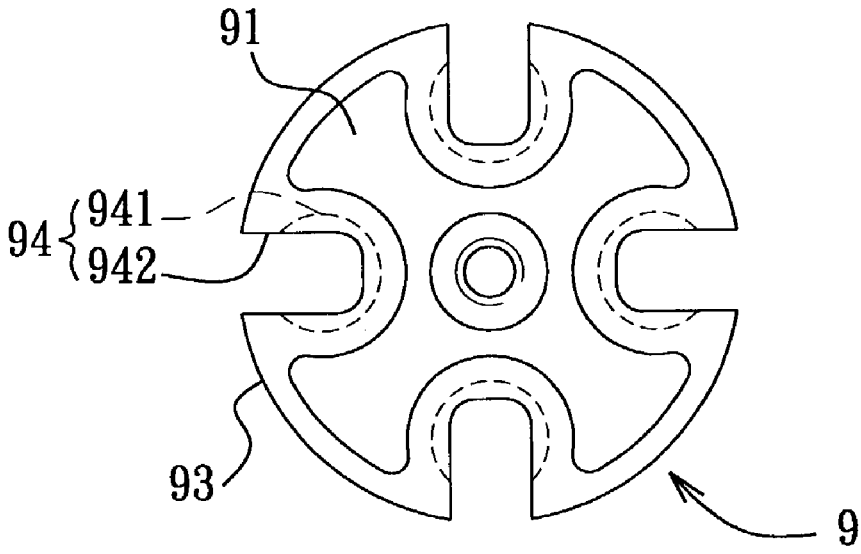
FIG. 9 is a view similar to FIG. 7, with a top cover and the upper ribs removed.

FIGS. 3 to 9 illustrate a collapsible tent skeleton frame that includes: a plurality of parallel poles 2 extending in a vertical direction, each of the poles 2 having top and bottom ends 21, 22; a plurality of joint units 3, each of which is mounted securely on the top end 21 of a respective one of the poles 2, and each of which includes an upper joint 4 and a lower joint 5 that is disposed below and that is spaced apart from the upper joint 4, each of the upper and lower joints 4, 5 having a sleeve 6 that is sleeved on the respective one of the poles 2, and two pivot arms 7 that extend outwardly and laterally from the sleeve 6 and that are angled away from each other, each of the pivot arms 7 having opposite top and bottom faces 71, 72 and a free end 73, and being formed with a first recess 74 that extends inwardly from the free end 73 in a transverse direction relative to the respective one of the poles 2, the first recess 74 having a round inner end section 741 that is remote from the free end 73, and an extension 742 that is reduced and that extends from the inner end section 741 in the transverse direction to the free end 73 and that extends through the top and bottom faces 71, 72 in the vertical direction, the upper joint 4 further having an upper cover 41 that is secured to and that covers the top faces 71 of the pivot arms 7 of the upper joint 4, the lower joint 5 further having a lower cover 51 that is secured to and that covers the bottom faces 72 of the pivot arms 7 of the lower joint 5; a plurality of first side ribs 81, each of which has opposite first and second ends 811, 812 and a non-circular section 813 that extends from the first end 811, and each of which extends inclinedly and downwardly from a respective one of the pivot arms 7 of the upper joint 4 on a respective one of the poles 2 toward an adjacent one of the poles 2, the first end 811 being rounded and being rotatably received in and conforming to the inner end section 741 of the first recess 74 in the respective one of the pivot arms 7 of the upper joint 4 on the respective one of the poles 2, the non-circular section 813 being received in and conforming to the extension 742 of the first recess 74 in the respective one of the pivot arms 7 of the upper joint 4 on the respective one of the poles 2 so as to limit rotation of the first side rib 81, each of the first side ribs 81 being rotatable upwardly and downwardly about a first axis that is transverse to the respective one of the poles 2 and to the respective one of the pivot arms 7 of the upper joint 4 on the respective one of the poles 2, each of the first side ribs 81 being limited by the upper cover 41 of the upper joint 4 on the respective one of the poles 2 from further upward rotation about the first axis, the second ends 812 of an adjacent pair of the first side ribs 81 being disposed between an adjacent pair of the poles 2 and being pivoted to each other; a plurality of second side ribs 82, each of which has opposite first and second ends 821, 822 and a non-circular section 823 that extends from the first end 821 thereof, and each of which extends inclinedly and upwardly from a respective one of the pivot arms 7 of the lower joint 5 on a respective one of the poles 2 toward an adjacent one of the poles 2, the first end 821 of each of the second side ribs 82 being rounded and being rotatably received in and conforming to the inner end section 741 of the first recess 74 in the respective one of the pivot arms 7 of the lower joint 5 on the respective one of the poles 2, the non-circular section 823 of each of the second side ribs 82 being received in and conforming to the extension 742 of the first recess 74 in the respective one of the pivot arms 7 of the lower joint 5 on the respective one of the poles 2 so as to limit rotation of the second side rib 82, each of the second side ribs 82 being rotatable upwardly and downwardly about a second axis that is transverse to the respective one of the poles 2 and to the respective one of the pivot arms 7 of the lower joint 5 on the respective one of the poles 2, each of the second side ribs 82 being limited by the lower cover 51 of the lower joint 5 on the respective one of the poles 2 from further downward rotation about the second axis, the second ends 822 of an adjacent pair of the second side ribs 82 being disposed between an adjacent pair of the poles 2 above the second ends 812 of an adjacent pair of the first side ribs 81, and being pivoted to each other, each of the second side ribs 82 intersecting and being pivoted to an adjacent one of the first side ribs 81; a top joint 9 disposed above the top ends 21 of the poles 2 at a center position relative to the poles 2; and a plurality of upper ribs 83, each of which extends inclinedly and downwardly from the top joint 9, and each of which has a first end 831 that is pivoted to the top joint 9, and a second end 832 that is pivoted to the second end 822 of one of an adjacent pair of the second side ribs 82.

The top joint 9 has top and bottom faces 91, 92, and a peripheral side wall 93 that is transverse to the top and bottom faces 91, 92, and is formed with a plurality of angularly spaced apart second recesses 94 that extend inwardly from the peripheral side wall 93. Each of the second recesses 94 has a round inner end section 941 that is opposite to the peripheral side wall 93, and an extension 942 that is reduced and that extends from the inner end section 941 to the peripheral side wall 93 and that extends through the top and bottom faces 91, 92 of the top joint 9 in the vertical direction. The top joint 9 further has a top cover 95 that is secured to and that covers the top face 91 thereof. The first end 831 of each of the upper ribs 83 is rounded and is rotatably received in and conforms to the inner end section 941 of a respective one of the second recesses 94 in the top joint 9. Each of the upper ribs 83 further has a non-circular section 833 that extends from the first end 831 and that is received in and that conforms to the extension 942 of the respective one of the second recesses 94 in the top joint 9 so as to limit rotation of the upper rib 83, each of the upper ribs 83 being rotatable upwardly and downwardly about a third axis that is transverse to an adjacent pair of the poles 2. Each of the upper ribs 83 is limited by the top cover 95 from further upward rotation about the third axis.

The tent skeleton frame further includes a plurality of lower ribs 84, each of which has a first end 841 that is pivoted to the second end 812 of one of an adjacent pair of the first side ribs 81, and a second end 842 that is opposite to the first end 841 and that is pivoted to an adjacent one of the upper ribs 83.

By virtue of the rounded shape of the first end 811, 821, 831 of each of the first and second side ribs 81, 82 and the upper ribs 83, the pivotal action of each of the first and second side ribs 81, 82 and the upper ribs 83 is smoother than that of the side ribs of the aforesaid conventional collapsible tent skeleton frame.

With the invention thus explained, it is apparent that various modifications and variations can be made without departing from the spirit of the present invention.

I claim:

1. A collapsible tent skeleton frame, comprising:

a plurality of parallel poles extending in a vertical direction, each of said poles having a top end;

a plurality of joint units, each of which is mounted securely on said top end of a respective one of said poles, and each of which includes an upper joint and a lower joint that is disposed below and that is spaced apart from said upper joint, each of said upper and lower joints having a sleeve that is sleeved on the respective one of said poles, and two pivot arms that extend outwardly and laterally from said sleeve and that are angled away from each other, each of said pivot arms having opposite top and bottom faces and a free end, and being formed with a first recess that extends inwardly from said free end in a transverse direction relative to the respective one of said poles, said first recess having a round inner end section that is remote from said free end, and an extension that is reduced and that extends from said inner end section in said transverse direction to said free end and that extends through said top and bottom faces in said vertical direction, said upper joint further having an upper cover that is secured to and that covers said top faces of said pivot arms of said upper joint, said lower joint further having a lower cover that is secured to and that covers said bottom faces of said pivot arms of said lower joint;

a plurality of first side ribs, each of which has opposite first and second ends and a non-circular section that extends from said first end, and each of which extends inclinedly and downwardly from a respective one of said pivot arms of said upper joint on a respective one of said poles toward an adjacent one of said poles, said first end being rounded and being rotatably received in and conforming to said inner end section of said first recess in the respective one of said pivot arms of said upper joint on the respective one of said poles, said non-circular section being received in and conforming to said extension of said first recess in the respective one of said pivot arms of said upper joint on the respective one of said poles so as to limit rotation of said first side rib, each of said first side ribs being rotatable upwardly and downwardly about a first axis that is transverse to the respective one of said poles and to the respective one of said pivot arms of said upper joint on the respective one of said poles, each of said first side ribs being limited by said upper cover of said upper joint on the respective one of said poles from further upward rotation about said first axis, said second ends of an adjacent pair of said first side ribs being disposed between an adjacent pair of said poles and being pivoted to each other;

a plurality of second side ribs, each of which has opposite first and second ends and a non-circular section that extends from said first end thereof, and each of which extends inclinedly and upwardly from a respective one of said pivot arms of said lower joint on a respective one of said poles toward an adjacent one of said poles, said first end of each of said second side ribs being rounded and being rotatably received in and conforming to said inner end section of said first recess in the respective one of said pivot arms of said lower joint on the respective one of said poles, said non-circular section of each of said second side ribs being received in and conforming to said extension of said first recess in the respective one of said pivot arms of said lower joint on the respective one of said poles so as to limit rotation of said second side rib, each of said second side ribs being rotatable upwardly and downwardly about a second axis that is transverse to the respective one of said poles and to the respective one of said pivot arms of said lower joint on the respective one of said poles, each of said second side ribs being limited by said lower cover of said lower joint on the respective one of said poles from further downward rotation about said second axis, said second ends of an adjacent pair of said second side ribs being disposed between an adjacent pair of said poles above said second ends of an adjacent pair of said first side ribs, and being pivoted to each other, each of said second side ribs intersecting and being pivoted to an adjacent one of said first side ribs;

a top joint disposed above said top ends of said poles at a center position relative to said poles; and a plurality of upper ribs, each of which extends inclinedly and downwardly from said top joint, and each of which has a first end that is pivoted to said top joint, and a second end that is pivoted to said second end of one of an adjacent pair of said second side ribs.

2. The collapsible tent skeleton frame of claim 1, wherein said top joint has top and bottom faces, and a peripheral side wall that is transverse to said top and bottom faces, and is formed with a plurality of angularly spaced apart second recesses that extend inwardly from said peripheral side wall, each of said second recesses having a round inner end section that is remote from said peripheral side wall, and an extension that is reduced and that extends from said inner end section thereof to said peripheral side wall and that extends through said top and bottom faces of said top joint in said vertical direction, said top joint further having a top cover that is secured to and that covers said top face thereof, said first end of each of said upper ribs being rounded and being rotatably received in and conforming to said inner end section of a respective one of said second recesses in said top joint, each of said upper ribs further having a non-circular section that extends from said first end thereof and that is received in and that conforms to said extension of the respective one of said second recesses in said top joint so as to limit rotation of said upper rib, each of said upper ribs being rotatable upwardly and downwardly about a third axis that is transverse to an adjacent pair of said poles, each of said upper ribs being limited by said top cover from further upward rotation about said third axis.

3. The collapsible tent skeleton frame of claim 2, further comprising a plurality of lower ribs, each of which has a first end that is pivoted to said second end of one of an adjacent pair of said first side ribs, and a second end that is opposite to said first end and that is pivoted to an adjacent one of said upper ribs.

* * * * *